United States Patent [19]

Hade et al.

[11] 4,314,458

[45] Feb. 9, 1982

[54] REFRIGERATED DISPLAY CASE

[75] Inventors: Conrad Hade, South Salem; Dale D. Robinson, Spring Valley, both of N.Y.

[73] Assignee: Dalcon Marketing Inc., Port Chester, N.Y.

[21] Appl. No.: 192,738

[22] Filed: Oct. 1, 1980

[51] Int. Cl.[3] ..... A47F 3/04

[52] U.S. Cl. ..... 62/256

[58] Field of Search ..... 62/252, 253, 255, 256

[56] References Cited

U.S. PATENT DOCUMENTS

| | | | |
|---|---|---|---|
| 2,986,019 | 5/1961 | Happer | 62/255 X |
| 3,009,333 | 11/1961 | Rainwater | 62/256 |
| 3,115,019 | 12/1963 | Rutishauser | 62/256 |
| 3,306,068 | 2/1967 | Allgeyer et al. | 62/255 X |
| 3,365,907 | 1/1968 | Barroero | 62/256 |
| 3,593,538 | 7/1971 | Bachman | 62/256 |
| 4,267,706 | 5/1981 | Abraham | 62/256 |

FOREIGN PATENT DOCUMENTS

| | | | |
|---|---|---|---|
| 719434 | 10/1965 | Canada | 62/256 |
| 1379114 | 10/1964 | France | 62/256 |

*Primary Examiner*—Lloyd L. King

*Attorney, Agent, or Firm*—Kirschstein, Kirschstein, Ottinger & Cobrin

[57] ABSTRACT

A 360° open circular refrigerated display case which features a plurality of horizontal circular display shelves, aligned in a vertical series one above the other. Unique cold and warmed air circulation patterns are provided by the configurations of the shelves and central foraminous ducts. Cascading air curtains flow from top to bottom in the refrigerated display case in a unique flow pattern, i.e. downwards from shelf to shelf and successively inwards and outwards below each shelf, guided by the shelf itself which acts as a baffle. A specific circular configuration of a refrigerated display case with horizontal trays and cold air flow about the trays, which are hollow, as well as a specific arrangement of two adjacent trays or a single hollow tray, as well as the baffles and flow arrangement, as disclosed.

25 Claims, 9 Drawing Figures

FIG. 8
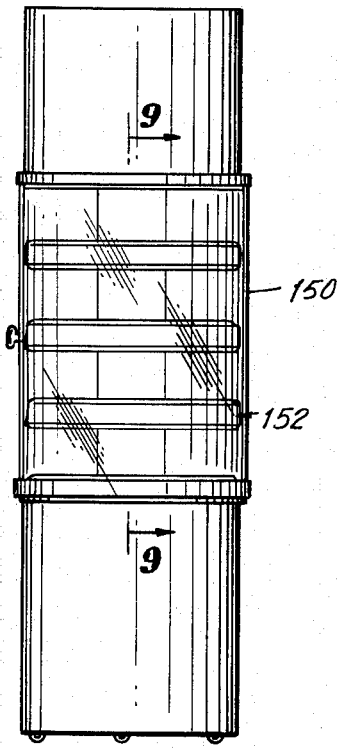
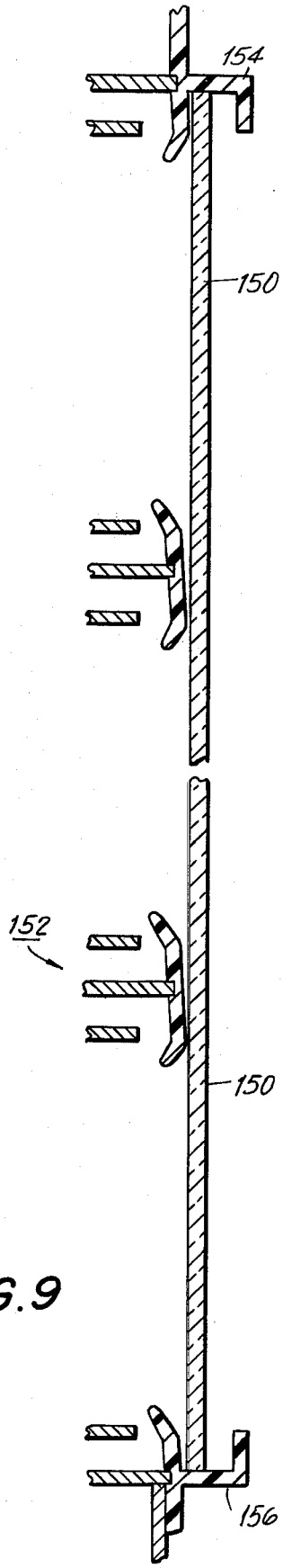
FIG. 9

REFRIGERATED DISPLAY CASE

BACKGROUND OF THE INVENTION

1. Field of the Invention

A refrigerated display case.

2. Description of the Prior Art

Refrigerated display cases for the display of foods and beverages which require refrigeration to prevent spoilage are well known, and various types of such cases are to be found in most supermarkets, grocery stores, butcher shops, dairy food stores etc. Rectangular, e.g. square, as well as circular i.e. cylindrical units, which may or may not be free-standing i.e. island type, have been disclosed in the prior art. Most units feature sliding or hinged glass or clear plastic doors for easy viewing of the contents of the case, usually displayed on interior shelves, as well as an integral mechanical refrigeration unit. Cold air flows are directed in various directions out and back, through the shelves, and around the outer perimeter of the case. Most supermarkets are provided with upright refrigerated cabinets having sliding or hinged vertical glass or clear plastic doors, and which contain ice cream or frozen food packages. Open coffin units or flat refrigerated display cases, with the top open and for the display of cuts of meat, milk, cheese or fruit juices, are also in most modern supermarkets.

Among the abundance of prior art relative to refrigerated display cases may be mentioned U.S. Pat. Nos. 2,986,019; 3,009,333; 3,115,019; 3,139,738; 3,168,818; 3,304,736; 3,306,068; 3,365,907 and 3,392,543.

SUMMARY OF THE INVENTION

Purposes of the Invention

It is an object of the present invention to provide an improved refrigerated display case.

A further object is to provide a free-standing open refrigerated display case in which comestibles, either solid or liquid, are displayed in an improved and more attractive manner for sale.

An additional object is to provide a shelved refrigerated display case in which cascading air curtains flow from top to bottom in the case and successively inwards and outwards below each shelf.

Still another object is to provide a refrigerated display case in which the air currents are guided by the shelves which act as baffles.

Still a further object is to provide a refrigerated display case in which refrigeration air flow is channeled laterally outwards and inwards by the shelves.

Still another object is to provide a refrigerated display case in which an outer peripheral cold air curtain protects the contents of the case from spoilage.

Still another object is to provide a free-standing vertical refrigerated display case in which an outer cascading cold air flow permits the case to be installed and used without necessitating the provision of sliding or hinged glass doors, i.e. a case in which access to the food product being sold to the customer is facilitated by the omission of any intervening solid barrier. An object is to provide a refrigerated display case in which the customer merely reaches into the case and onto a shelf on which the product is being displayed for sale, and directly selects the product for purchase, without having to first look through an intervening glass or plastic door, which may be fogged or frosted over, and then manually opening the door to grasp and retrieve the desired package or product.

Another object is to provide an improved open circular refrigerated display case.

An object is to provide a mobile, multi-shelf, free standing, 360° open refrigerated display merchandiser island maintaining a temperature level typically below 40° F.

An object is to provide a refrigerated display case having a unique air curtain flow in which each shelf has its own air curtain.

An object is to provide a refrigerated display case which displays the product in an improved manner and which is a self-contained shelf type unit which does not have to the completely enclosed in glass or plastic.

An object is to provide a refrigerated display case in which air flow under the product shelf aids in cooling of the product.

An object is to provide a refrigerated display case in which the upward and downward discharge of air not only creates a laminar barrier, but also, combined with negative pressure suction, produces a minimum amount of spillage of cold air, which tends to reduce energy consumption.

These and other objects and advantages of the present invention will become evident from the description which follows.

Brief Description of the Invention

In the present invention, two specific embodiments of the general refrigerated display case configuration are contemplated. In one embodiment of the invention, the refrigerated display case includes upright vertically oriented rectilinear inner (first) and outer (second) ducts which are coaxial, so that the outer duct is concentrically disposed about the inner duct. The inner duct defines a central vertical passage for downwards flow of warmed, i.e. heated, air. The annular space between the inner and outer ducts defines an annular vertical passage for upwards flow of cold air. The shelves or trays of the unit are generally horizontal each defined by baffles which extend laterally outwards from the outer duct. Thus, for each shelf unit, first and second spaced apart juxtaposed generally horizontal baffles extend outwards from attachment to the outer duct. The first baffle is an upper baffle relative to the second lower baffle. A middle generally horizontal baffle is disposed between and spaced from the first and second baffles, and the middle baffle also extends outwards from attachment to the outer duct.

The outer duct is foraminous; a first plurality of foramina is spaced between the attachments of the first (upper) and middle baffles, so as to permit lateral flow of cold air from the annular passage between the ducts, into and laterally (radially) outwards through the passage between the first (upper) baffle and the middle baffle. The outer duct is also provided with a second plurality of foramina which are spaced between the attachments of the middle and second (lower) baffles, so as to permit lateral flow of cold air from the annular passage between the ducts, into and laterally (radially) outwards through the passage between the middle baffle and the second (lower) baffle.

A first plurality of tubular members extends in the annular passage between the first duct and the second duct, and above the first (upper) baffle, so as to provide a first through passage for warmed air from above the first baffle, and from external to the second duct, to within the first duct. A second plurality of tubular members extends in the annular passage between the first duct and the second duct, and below the second (lower) baffle, so as to provide a second through passage for warmed air below the second baffle, and from external to the second duct to within the first duct.

The first embodiment of the invention as described supra is completed by the provision of air refrigeration means which is usually any form of mechanical refrigeration and which is disposed below the lower ends of the ducts, together with means to pass warm i.e. heated air downwards through the first duct and from the lower end of the first duct into and through the air refrigeration means, so that the warm air is cooled, and means to pass the resulting cold air from the air refrigeration means into and upwards through the annular passage between the first duct and the second duct.

In an alternative embodiment of the invention, a modified configuration of shelf and air flow pattern is provided. The alternative refrigerated display case includes, as before, the inner first duct and outer second duct, typically arranged in a concentric configuration, as described supra. In addition, the first upper, second lower, and middle baffles are as before. However, in this embodiment of the invention, only one plurality of foramina are provided in the second duct, the foramina being disposed and spaced between the attachment of the middle baffle and the second (lower) baffle, so as to permit lateral flow of cold air from the annular passage between the first duct and the second duct, into and laterally outwards through the passage between the middle baffle and the second (lower) baffle. In addition, only one plurality of tubular members is provided; these members extend in the annular passage between the first duct and the second duct, and from between the upper first baffle and the middle baffle to the first duct, so as to provide a through passage for warmed air from between the upper first baffle and the middle baffle, to within the first duct. Thus, as will appear infra, the air flow pattern in this second alternative embodiment of the invention is different from that of the first embodiment of the invention as first described supra. The second embodiment of the invention also includes air refrigeration means, means to pass warmed i.e. heated air downwards through the first duct and to the air refrigeration means, and means to pass cold air upwards through the annular passage between the first duct and the second duct from the air refrigeration means, as before.

In most instances the first (upper) and second (lower) baffles will be of generally the same size, shape and orientation. In a preferred embodiment of the first embodiment of the invention, the second plurality of tubular members will have a smaller cross-section area than the first plurality of tubular members. The reason for this is to balance and equalize the flow of warmed air through the two pluralities of tubular members, i.e. there is a greater air flow pressure drop and longer air flow path in the external system of air flow to the first plurality of tubular members than to the second plurality of tubular members. In both embodiments of the invention, it is preferred that the second duct be provided with at least one opening below and adjacent to the second (lower) baffle, so that cold air can flow laterally outwards below the second baffle. This improves the cold air flow circulation pattern.

In both embodiments of the invention, it is preferred that a generally vertical air flow diversion baffle be provided and mounted to the outer end of the middle baffle, to facilitate and channel the requisite flow of air as desired, as will appear infra. In most instances, the air flow diversion baffle will extend from above the first (upper) baffle to below the second (lower) baffle, and in addition, it is preferred that the air flow diversion baffle be provided with at least one inwardly extending terminal extension; in the best mode of practicing the invention, terminal extensions are provided at both the upper and lower edges of the vertical air flow diversion baffle.

In most instances, the inner and outer ducts will be cylindrical and concentric, and in addition, in most cases the aforementioned first (upper), second (lower) and middle baffles will be flat and disc-shaped and with a circular perimeter, and these baffles in this configuration will be coaxially aligned in registration.

In a preferred embodiment, a generally horizontal cold air flow diversion baffle is provided and disposed below the lower end of the outer duct and above the air refrigeration means, so that cold air formed in the air refrigeration means is directed laterally outwards from the air refrigeration means, upwards around the outer edge of the cold air flow diversion baffle, and then inwards above this baffle to the annular passage between the inner and outer ducts. In this preferred embodiment of the invention, it is preferred in some instances that the first duct be provided with at least one opening above and adjacent to the horizontal cold air flow diversion baffle, so that cold air can flow laterally inwards into the lower end of the first duct, which as described supra contains warmed air. This apparently anomalous arrangement is beneficial in some cases, because in some instances when needed, air flow is balanced by excess cold air flow from the air refrigeration means bypassing the annular passage between the first duct and the second duct. The bypass arrangement is necessary in some cases to balance the air flow, since the fan must produce a CFM (cubic feet per minute of air flow) necessary to clear the coil. But this CFM is excessive for use in the shelf or tray area, hence it is dampered by the cold air bypass to balance the flow of air.

It is preferred, in both embodiments of the invention, that the means to pass air to and from the air refrigeration means include a backward curved centrifugal fan. This is highly advantageous in providing compact design, especially with a round, i.e. circular or cylindrical, refrigeration coil, quiet operation, high air flow, even coil loading and air distribution, and rapid defrost (air).

Finally, a major advantage of the present invention is that the upward and downward discharge of air permits the case unit to be an open free-standing island in a supermarket or grocery store, without intervening sliding or hinged glass or plastic doors which could diminish customer purchase of a food product. However, it is also feasible in some instances to provide one or a plurality of sliding (or hinged) transparent vertical glass or clear plastic doors about at least a portion of the outer periphery of the refrigerated display case. In general however, such doors will be omitted; the upward and downward discharge of air is usually all that is needed since a laminar barrier is created which insures ample cooling of the product prior to purchase. In addition, combined with the negative pressure suction, the unique air discharge mode results in a minimum amount of air spillage taking place. This tends to reduce energy consumption.

Thus in summary, the invention entails the provision of a 360° open circular refrigerated display case, which is usually of vertically oriented cylindrical configuration. The case features a plurality of spaced apart horizontal circular display shelves or trays, aligned in a vertical series one above the other. Unique cold and warmed air circulation patterns are provided by the configurations of the shelves and central vertical foraminous ducts for transport of warmed and cold air, respectively, to and from lower mechanical air refrigeration means. Cascading cold air curtains flow from top to bottom in the refrigerated display case in unique flow patterns, i.e. downwards and/or upwards from shelf to shelf, and successively outwards and inwards through each shelf and/or between each shelf, guided by the shelf itself which acts as a baffle. In a preferred embodiment, a specific circular configuration of a vertical refrigerated display case with hollow horizontal trays or shelves, and cold air flow about the trays, is provided. In addition, the invention features a specific arrangement of two adjacent trays or a single hollow tray, as well as a unique baffles and flow arrangement.

The present invention provides several solient advantages. The present improved refrigerated display case is a free-standing, island-type, open upright vertical refrigerated display case which offers ready access by the shopper to solid and liquid food products due to the absence of intervening sliding or hinged glass doors. The comestibles, either solid or liquid, are displayed in an improved and more attractive manner in the present free-standing open refrigerated display case. The shelved case features cascading air curtains which flow from top to bottom in the case and successively inwards and outwards below each shelf, and which act as a thermal barrier thus obviating the necessity for intervening barriers such as sliding glass or plastic doors, which in the prior art block ready access to the displayed products and prevent the immediate impulse grasping and retention of the product by the customer, and subsequent purchase of the same. Thus, refrigerated product sales are improved and commerce in the country is stimulated. The cascading air currents are guided in situ by the shelves themselves, which act as baffles. The refrigeration air flow is channeled laterally outwards and inwards by the horizontal shelves themselves, thus the present shelves perform a dual function in both guiding the air flow and holding the product for display. The outer peripheral cold air curtain effectively protects the refrigerated food contents of the case from spoilage and thus inventory loss of perishable foodstuffs in commercial supermarkets and grocery stores in substantially reduced. The present free-standing vertical refrigerated display case provides an outer cascading cold air flow, which permits the case to be installed and used without necessitating the provision of sliding or hinged glass or clear plastic doors or other solid thermal barrier, i.e. in the present case, access to the food product being sold to the the customer is facilitated by the omission of any intervening solid barrier. In the present invention, the customer merely reaches into the refrigerated case and onto a shelf or tray on which the product is being displayed for sale, and directly selects the product for purchase, without having to first look through a glass or clear plastic door, which may be fogged or frosted over thus discouraging would-be shoppers from an impulse purchase, and then, secondly, having to manually open the door to grasp and retrieve the desired package or product. Thus, shopping for cold or refrigerated or frozen foodstuffs such as ice cream, frozen food packages such as frozen fish fillets or other seafood, or non-frozen foodstuffs such as cuts of meat or chicken, cold cuts, milk, cheese, yogurt, other dairy products, fruit juices such as orange or grapefruit juice, etc., has now been facilitated and made much easier, simpler and faster. The present invention provides a mobile, multi-shelf, free standing, 360° open refrigerated display merchandiser island maintaining an interior temperature level typically below 40° F. The present refrigerated display case has a unique air curtain flow in which each shelf has its own air curtain. The case displays the product in an improved manner, and the case is a self-contained shelf type unit which does not have to be completely glass enclosed. In the present case, air flow under the product shelf aids in cooling of the product. Finally, in the present refrigerated display case, the upward and downward discharge of air not only creates a laminar barrier, but also, combined with negative pressure suction, produces a minimum amount of spillage of cold air, which tends to reduce energy consumption.

The invention accordingly consists in the features of construction, combination of elements, and arrangement of parts which will be exemplified in the article of manufacture hereinafter described, and of which the scope of application is as elucidated supra and as will be indicated in the appended claims.

BRIEF DESCRIPTION OF THE DRAWINGS

In the accompanying drawings in which are shown several of the various possible embodiments of the invention:

FIG. 8 is an overall elevation view of still another alternative refrigerated display case with wrap-around sliding transparent glass or clear plastic door; and FIG. 9 is a sectional elevation view taken substantially along the line 9—9 of FIG. 8.

DETAILED DESCRIPTION OF THE PREFERRED EMBODIMENTS

Figure 1:
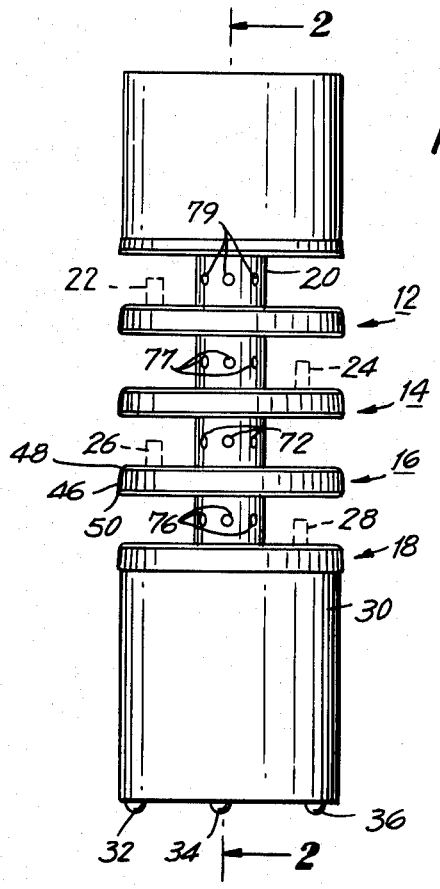
FIG. 1 is an overall elevation view of one embodiment of the present refrigerated display case.
Figure 3:
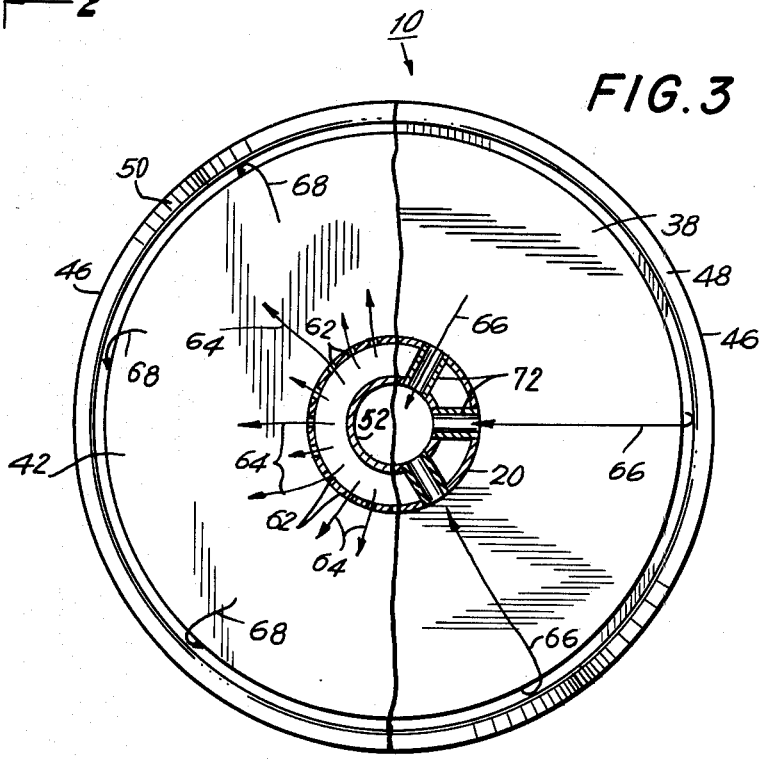
FIG. 3 is a sectional plan view taken substantially along the line 3—3 of FIG. 2.
Figure 2:
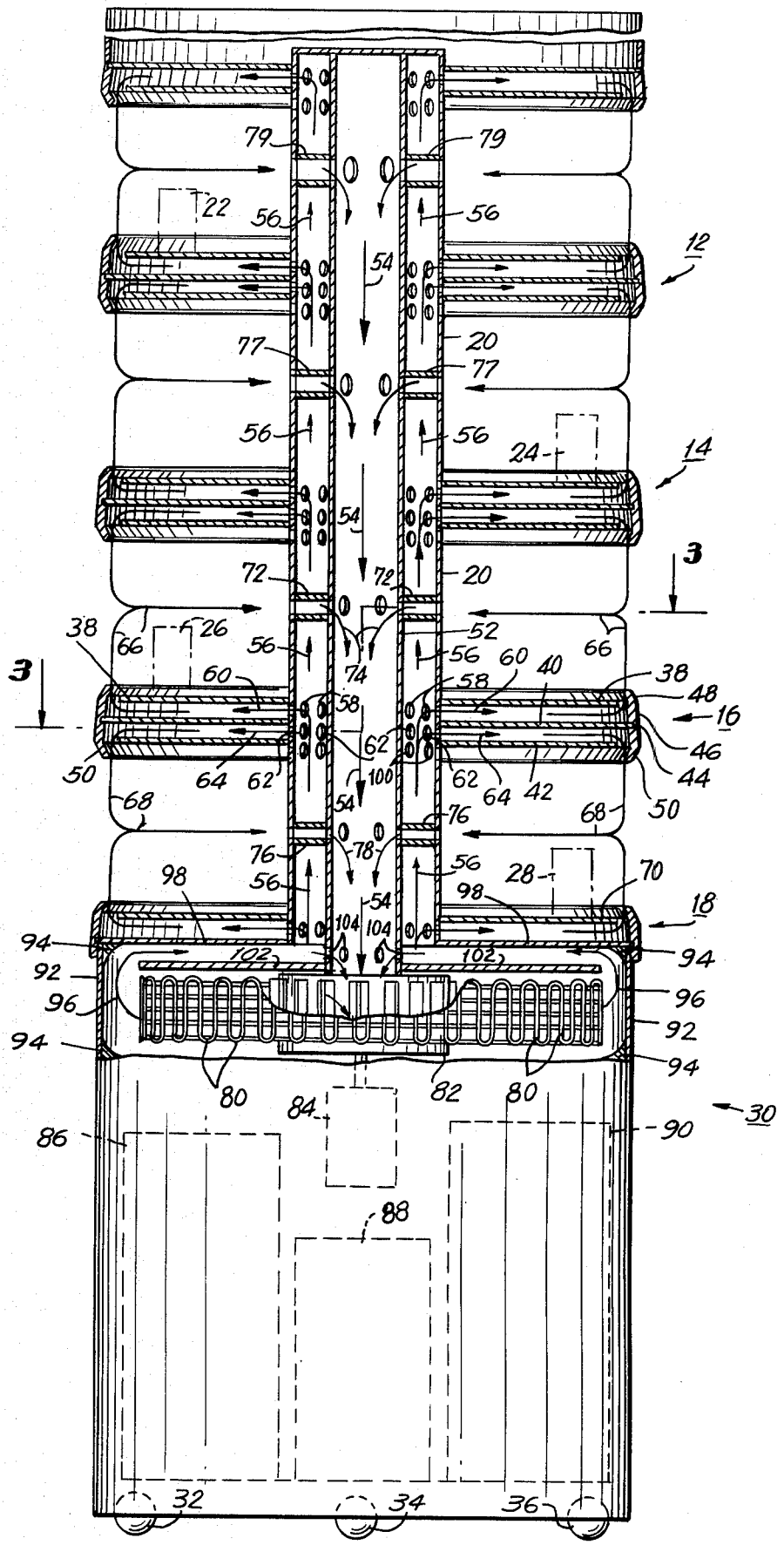
FIG. 2 is a sectional elevation view taken substantially along the line 2—2 of FIG. 1.

Referring now to FIGS. 1, 2 and 3, with particular reference to FIG. 2, the present refrigerated display case 10 is characterized by the provision of a plurality of circular horizontal shelves or trays 12, 14, 16 and 18 of generally equal dimension and aligned coaxially and in registration at spaced intervals, and mounted on an outer foraminous upright vertically oriented rectilinear duct 20. As shown in phantom outline, packages or containers 22, 24, 26 and 28 of a comestible are disposed on the shelves. A mechanical refrigeration unit 30 is disposed at the lower end of the case 10, and the entire refrigerated display case 10 is an island-type unit which is free-standing and mounted on bottom casters 32, 34 and 36 for easy movement to a desired location on a supermarket floor.

Referring now to a typical shelf or tray unit 16, and with particular reference to FIGS. 2 and 3, the shelf unit 16 is characterized by the provision of an upper (first) baffle 38, a middle baffle 40 and a lower (second) baffle 42. These baffles 38, 40 and 42, in this embodiment of the invention, are spaced-apart circular or disc-shaped horizontal elements arranged in registration, as best seen in FIG. 2. The first (upper) baffle 38 and the second (lower) baffle 42 are of generally the same size, circular or disc-shaped configuration, and horizontal orientation. The middle baffle 40 extends outwards to an outer perimetral edge 44, which is slightly beyond the outer edges of the baffles 38 and 42, and a generally vertical air flow diversion baffle 46 is mounted to the outer end or edge 44 of the middle baffle 40. The baffle 46 extends from at or above the level of the first (upper) baffle 38, to at or below the level of the second (lower) baffle 42. The baffle 46 is provided with inwardly extending terminal extensions which are spaced from the outer edges of the respective baffles 38 and 42, i.e. upper extension 48 and lower extension 50. The inner edges of the baffles 38, 40 and 42 are attached to the outer surface of the outer duct 20, so that the baffle 38, 40 and 42 are mounted to the outer duct 20 in cantilever fashion.

The outer duct 20 is coaxially and concentrically disposed external to an inner upright vertically oriented rectilinear duct 52. The inner duct 52 is provided for downwards flow of warmed i.e. heated, air, as indicated by the arrows 54, while the annular space between the inner duct 52 and the outer duct 20 accommodates upward flow of cold air, as indicated by the arrows 56, which cold air is derived from the mechanical refrigeration element 30, the upper portion of which is shown in detail in FIG. 2. The outer duct 20 is foraminous, as mentioned supra. A first plurality of foramina 58 consisting of small circular holes or openings in the duct 20 is spaced between the respective attachments of the first (upper) baffle 38 and the middle baffle 40, to the duct 20, so as to permit lateral flow of cold air (arrow 60) from the annular passage between the ducts 52 and 20, into and laterally (radially) outwards through the passage or spacing between the first (upper) baffle 38 and the middle baffle 40. The outer duct 20 is also provided with a second lower plurality of foramina 62 consisting of small circular holes or openings. The foramina 62 are spaced between the respective attachments of the middle baffle 40 and the second (lower) baffle 42 to the outer duct 20, so as to permit lateral flow of cold air (arrow 64) from the annular passage between the ducts 52 and 20, into and laterally (radially) outwards through the passage or spacing between the middle baffle 40 and the second (lower) baffle 42. The cold air (arrows 60 and 64) thus flows radially outwards on both sides of the middle baffle 40, and is subsequently diverted by vertical baffle 46, and terminal extensions 48 and 50, both upwards and inwards above upper baffle 38, and downwards and inwards below lower baffle 42, as shown by the respective air flow arrows 66 and 68.

The air flow arrows 66 and 68 show how the cold air flow protects and cools or refrigerates comestibles disposed on upper baffle 38, such as comestible element 26 shown in plantom outline; the cold air flow via arrow 68 protects and cools comestible 28 disposed on a baffle 70 of the next lower shelf or tray 18. It is important to note that, first, generally laminar vertical flow of cold air streams 66 and 68 is accomplished, which keeps warm ambient air out of the shelf regions, and out of contact with the comestibles, by preventing ambient air flow into the spacing between adjacent shelves, i.e. a vertical air barrier or curtain is effectively established. This is followed by inwards horizontal flow across the spacing between adjacent shelves or trays and in direct cooling contact with the supply of comestibles desposed on each shelf or tray. As a consequence of this cold air flow via streams 66 and 68, the circulating air 66 and 68 becomes warmed, while providing cooling or refrigeration between the shelves to thereby protect the comestibles from spoilage.

In order to recover and recycle the now warmed air flowing inwards and adjacent to the outside of outer duct 20, a first plurality of tubular members 72 extends in the annular passage between the outer duct 20 and the inner duct 52. The tubular members 72 are disposed above the first (upper) baffle 38, so as to provide a first through passage for warmed air (the downstream portion of arrow 66), from above the first (upper) baffle 38, and from external to the outer duct 20, to within the inner duct 52, as shown by arrows 74. A second plurality of tubular members 76 extends in the annular passage between the outer duct 20 and the inner duct 52, and below the second (lower) baffle 42, so as to provide a second through passage for warmed air (the downstream portion of arrow 68), from below the second (lower) baffle 42, and from external to the outer duct 20, to within the inner duct 52, as shown by arrows 78. The lower tubular members 76 are of slightly smaller diameter and cross-sectional area than the upper tubular members 72, which in turn are smaller than the next upper tubular members 77, which in turn are smaller than the top tubular members 79, for reasons explained supra, i.e. to balance gas flow pressure drop in the unit.

This embodiment of the refrigerated display case also includes the lower air refrigeration means 30, which is generally any form of mechanical refrigeration, i.e. a unit including a vertical cylindrical air cooling coil 80 composed of a sinusoidal continuous series of tubular U-bends through which cold refrigerant such as a Freon (a halogenated hydrocarbon), methyl chloride, ammonia, sulfur dioxide, propane, Dowtherm, carbon dioxide or other suitable refrigerant fluid known to the art is circulated. The refrigeration means 30 also includes, in this embodiment of the invention, a backward curved centrifugal fan 82 driven by a motor 84 shown in phantom outline. Other elements of the mechanical refrigeration 30, such as the compressor, refrigerant fluid reservoir, compressor motor, and means to discharge heat from compressed refrigerant to ambient atmosphere, which are provided in known mechanical refrigeration units and facilities, are generally shown in phantom outline as elements 86, 88 and 90 (FIG. 2).

The warmed or heated air stream 54 flowing downwards through inner duct 52 passes from duct 52 into the fan 82, the blades of which force the air outwards and across and in contact with cold refrigeration coil 80, so that the air is cooled. The cold air flowing radially outwards horizontally from coil 80 is now diverted upwards and inwards by the upper part 92 of the outer wall of unit 30. Rounded corners 94 of the air chamber are provided to facilitate and streamline the air flow by preventing turbulence, thus lessening pressure drop and reducing the load on the fan 82, thus lessening power consumption. Thus the re-cooled and cold air flows via arrows 96 out of the coil 80 and below partition 98 to recycle flow via 56 in the annular passage between ducts 52 and 20.

FIG. 2 illustrates additional preferred embodiments of the invention. The outer duct 20 is provided with a plurality of openings 100 below and adjacent to the second (lower) baffle 42, so that a portion of the cold air flow 56 can flow laterally outwards below the baffle 42, to improve the cold air flow circulation pattern. In addition, a generally horizontal cold air flow diversion baffle 102 will usually be disposed below the lower end of the outer duct 20 and above the coil 82 and other appurtenances of the air refrigeration unit 30, so that the cold air formed in the coil 80 is directed laterally outwards from coil 80, upwards around the outer edge of baffle 102, and then inwards above the baffle 102 to the annular passage between the inner duct 32 and outer duct 20, to form stream 56. All of this flow pattern relative to baffle 102 is shown by the arrows 96. The inner duct 52 is preferably provided with openings 104 above and adjacent to the baffle 102, so that a portion of cold air stream 96 can flow laterally inwards into the lower end of the inner duct 52 to mingle with downflowing warm air stream 54, for the reasons explained supra.

Figure 4:
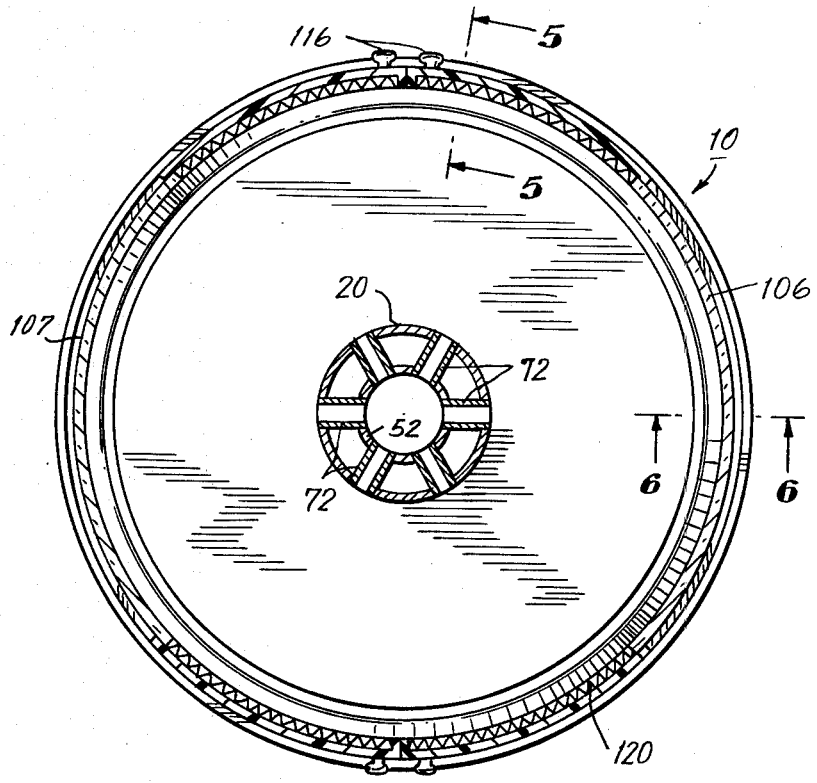
FIG. 4 is a sectional plan view similar to FIG. 3 but showing an alternative embodiment in which the refrigerated display case is provided with curved sliding transparent glass or clear plastic doors.
Figure 5:
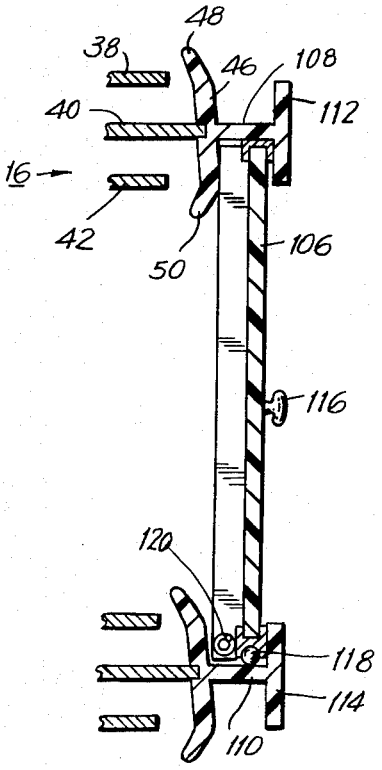
FIG. 5 is a sectional elevation view taken substantially along the line 5—5 of FIG. 4.
Figure 6:
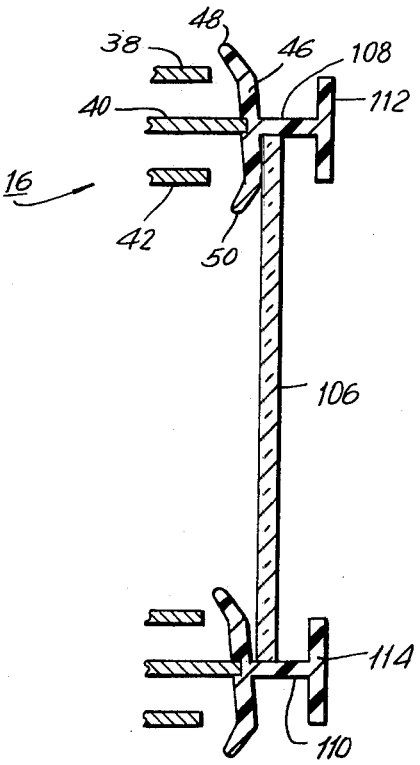
FIG. 6 is a sectional elevation view taken substantially along the line 6—6 of FIG. 4.

FIGS. 4, 5 and 6 illustrate how the cylindrical refrigerated display case of FIGS. 1, 2 and 3 may alternatively be optionally provided with a curved, wrap-around transparent glass or clear plastic door, or series of doors, or any suitable transparent outer enclosure. Thus, referring now to FIGS. 4, 5 and 6, the refrigerated display case 10 is as before, except that sliding doors such as doors 106 and 107 are provided for the unit. The door 106, as best seen in FIGS. 5 and 6, extends between two adjacent shelves or trays such as tray 16, and in conjunction with door 107, completely wraps around the refrigerated display case 10. The curved door 106 is mounted on tracks 108 and 110 which have outer guide rails 112 and 114 respectively. Handles such as handle 116 are provided, so that the door 106 may be slid on ball bearings 118 in track 110 and manipulated about the central vertical axis of the unit 10, so as to expose the contents of the case 10 to ready access by a prospective purchaser. At least a portion of the door 106 is transparent for easy viewing of the case contents from external to the case 10, being composed of glass or clear plastic. The door 106 is spring-loaded via springs such as spring 120, so that the door 106 will return to the normally closed position when the handle 116 is released.

Figure 7:
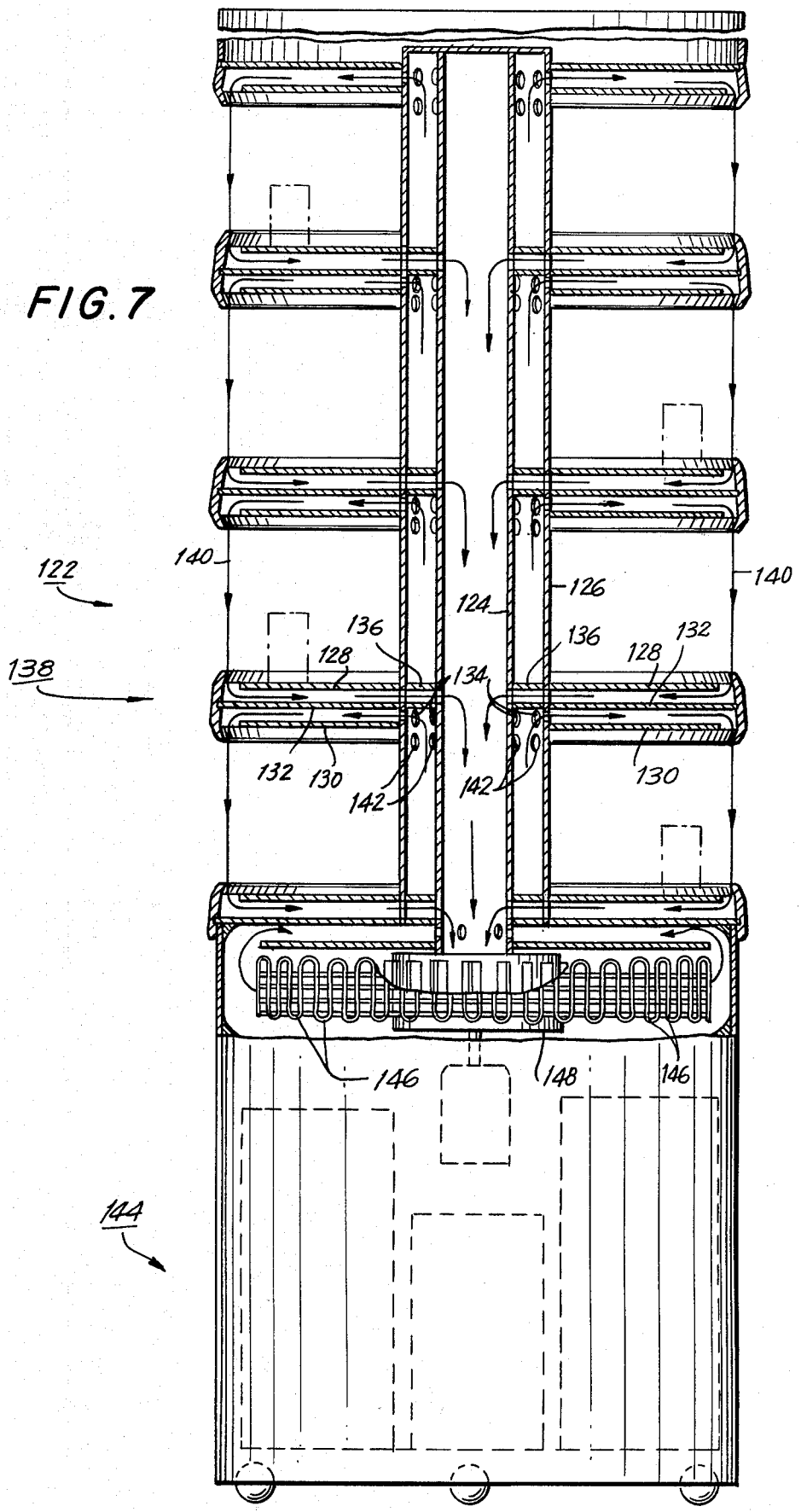
FIG. 7 is a sectional elevation view similar to FIG. 2 but showing an alternative embodiment of refrigerated display case of the invention.

FIG. 7 illustrates an alternative embodiment of the invention, in which a modified configuration of shelf and air flow pattern is provided. The alternative refrigerated display case 122 of FIG. 7 includes, as before, an inner first duct 124 and an outer second duct 126, arranged in a concentric and coaxial configuration. In addition, the first upper baffle 128, second lower baffle 130, and middle baffle 132 are as before. However, in the broadest and most general version of this embodiment of the invention, only one plurality of foramina 134 are provided in the second outer duct 126, the foramina 134 being disposed and spaced between the attachment of the middle baffle 132 and the second (lower) baffle 130 to the outer duct 126, so as to permit lateral flow of cold air from the annular passage between the inner duct 124 and the outer duct 126, only into and laterally outwards through the passage between the middle baffle 132 and the second (lower) baffle 130. In addition, only one plurality of tubular members 136 is provided for each shelf or tray unit, such as shelf 138. These members 136 extend in the annular passage between the inner duct 124 and the outer duct 126, and from between the upper first baffle 128 and the middle baffle 132 to the inner duct 124, so as to provide a through passage for warmed air from between the upper first baffle 128 and the middle baffle 132, to within the inner (first) duct 124. Thus, the air flow pattern in this second alternative FIG. 7 embodiment of the invention is different from that of the first FIG. 2 embodiment of the invention, in that in FIG. 7 a cold air curtain such as 138 flows downwards in laminar fashion from shelf to shelf at the outer edge of the refrigerated display case 122. Other appurtenances of the unit, such as optional lower holes or openings 142 in the outer duct 126 below the lower second baffle 130, and the mechanical refrigeration unit 144 having coil 146 and backward curved centrifugal fan 148, are as before.

FIGS. 8 and 9 illustrate how a single transparent wrap-around glass or clear plastic door 150 having a handle 152, and extending in a unitary fashion external to all of the shelves, such as shelf 152, may be provided for the refrigerated display case. The door 150 extends from upper track or groove 154 at the upper end of the unit, to lower track or groove 156 ar the lower end of the unit.

It thus will be seen that there is provided an article of manufacture consisting of a refrigerated display case which achieves the various objects of the invention and which is well adapted to meet the conditions of practical use.

As various embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although perferred and alternative embodiments have been shown and described in accordance with the Patent Statutes, the invention is not limited thereto or thereby.

Having thus described the invention, there is claimed as new and desired to be secured by Letters Patent:

1. A refrigerated display case comprising:

(A) an upright vertically oriented rectilinear inner first duct, (B) an upright vertically oriented rectilinear outer second duct, said second duct being disposed about and coaxial with said first duct, so that said first duct defines a central vertical passage for downwards flow of heated air, and so that the annular space between said first duct and said second duct defines an annular vertical passage for upwards flow of cold air, (C) first and second spaced apart juxtaposed horizontal baffles, each baffle extending outwards from attachment to said outer duct, the first baffle being an upper baffle and the second baffle being a lower baffle, (D) a middle horizontal baffle, said middle baffle being disposed between and spaced from said first and second baffles and extending outwards from attachment to said outer duct, (E) said second duct having a first plurality of foramina spaced between the attachment of said first baffle and the attachment of said middle baffle, so as to permit lateral flow of cold air from the annular passage between said first duct and said second duct into and laterally outwards through the passage between said first baffle and said middle baffle, (F) said second duct having a second plurality of foramina spaced between the attachment of said middle baffle and the attachment of said second baffle, so as to permit lateral flow of cold air from the annular passage between said first duct and said second duct into and laterally outwards through the passage between said middle baffle and said second baffle, (G) a first plurality of tubular members, said first plurality of tubular members extending in the annular passage between said first duct and said second duct and above said first baffle, so as to provide a first through passage for warmed air above said first baffle and from external to said second duct to within said first duct, (H) a second plurality of tubular members, said second plurality of tubular members extending in the annular passage between said first duct and said second duct and below said second baffle, so as to provide a second through passage for warmed air below said second baffle and from external to said second duct to within said first duct, (I) air refrigeration means, said air refrigeration means being disposed below the lower ends of said first and second ducts, (J) means to pass warm air downwards through said first duct and from the lower end of said first duct into and through said air refrigeration means, so that the warm air is cooled, and (K) means to pass the resulting cold air from said air refrigeration means into and upwards through the annular passage between said first duct and said second duct.

2. The refrigerated display case of claim 1 in which the first and second baffles are of substantially the same size.

3. The refrigerated display case of claim 1 in which the second plurality of tubular members has a smaller cross sectional area than the first plurality of tubular members.

4. The refrigerated display case of claim 1 in which the second duct is provided with at least one opening below and adjacent to the second baffle, so that cold air can flow laterally outwards below the second baffle.

5. The refrigerated display case of claim 1 in which a substantially vertical air flow diversion baffle is mounted to the outer end of the middle baffle.

6. The refrigerated display case of claim 5 in which the vertical air flow diversion baffle extends from above the first baffle to below the second baffle.

7. The refrigerated display case of claim 5 in which the vertical air flow diversion baffle has an inwardly extending terminal extension.

8. The refrigerated display case of claim 1 in which the inner and outer ducts are cylindrical and concentric.

9. The refrigerated display case of claim 1 in which a substantially horizontal air flow diversion baffle is disposed below the lower end of the outer duct and above the air refrigeration means, so that cold air formed in the air refrigeration means is directed laterally outwards from the air refrigeration means, upwards around the outer edge of said horizontal air flow diversion baffle, and inward above said horizontal air flow diversion baffle to the annular passage between the inner and outer ducts.

10. The refrigerated display case of claim 9 in which the first duct is provided with at least one opening above and adjacent to the horizontal air flow diversion baffle, so that cold air can flow laterally inwards into the lower end of the first duct, whereby the air flow is balanced and excess cold air flow from the air refrigeration means bypasses the annular passage between the first duct and the second duct.

11. The refrigerated display case of claim 1 in which at least one sliding vertical door is provided about at least a portion of the outer periphery of the refrigerated display case.

12. The refrigerated display case of claim 1 in which each of said baffles is disc-shaped with a circular perimeter, and said baffles are coaxially aligned.

13. The refrigerated display case of claim 1 in which the means to pass air of elements (J) and (K) includes a backward curved centrifugal fan.

14. A refrigerated display case comprising:

(A) An upright vertically oriented rectilinear inner first duct, (B) an upright vertically oriented rectilinear outer second duct, said second duct being disposed about and coaxial with said first duct, so that said first duct defines a central vertical passage for downwards flow of heated air, and so that the annular space between said first duct and said second duct defines an annular vertical passage for upwards flow of cold air, (C) first and second spaced apart juxtaposed horizontal baffles, each baffle extending outwards from attachment to said outer duct, the first baffle being an upper baffle and the second baffle being a lower baffle, (D) a middle horizontal baffle, said middle baffle being disposed between and spaced from said first and second baffles and extending outwards from attachment to said outer duct, (E) said second duct having a plurality of foramina spaced between the attachment of said middle baffle and the attachment of said second baffle, so as to permit lateral flow of cold air from the annular passage between said first duct and said second duct into and laterally outwards through the passage between said middle baffle and said second baffle, (F) a plurality of tubular members, said plurality of tubular members extending in the annular passage between said first duct and said second duct, and from between said upper first baffle and said middle baffle to said first duct, so as to provide a through passage for warmed air from between said upper first baffle and said middle baffle, and from external to said second duct, to within said first duct, (G) air refrigeration means, said air refrigeration means being disposed below the lower ends of said first and second ducts, (H) means to pass warm air downwards through said first duct and from the lower end of said first duct into and through said air refrigeration means, so that the warm air is cooled, and (I) means to pass the resulting cold air from said air refrigeration means into and upwards through the annular passage between said first duct and said second duct.

15. The refrigerated display case of claim 14 in which the first and second baffles are of substantially the same size.

16. The refrigerated display case of claim 14 in which the second duct is provided with at least one opening below and adjacent to the second baffle, so that cold air can flow laterally outwards below the second baffle.

17. The refrigerated display case of claim 14 in which a substantially vertical air flow diversion baffle is mounted to the outer end of the middle baffle.

18. The refrigerated display case of claim 17 in which the vertical air flow diversion baffle extends from above the first baffle to below the second baffle.

19. The refrigerated display case of claim 17 in which the vertical air flow diversion baffle has an inwardly extending terminal extension.

20. The refrigerated display case of claim 14 in which the inner and outer ducts are cylindrical and concentric.

21. The refrigerated display case of claim 14 in which a substantially horizontal air flow diversion baffle is disposed below the lower end of the outer duct and above the air refrigeration means, so that cold air formed in the air refrigeration means is directed laterally outwards from the air refrigeration means, upwards around the outer edge of said horizontal air flow diversion baffle, and inward above said horizontal air flow diversion baffle to the annular passage between the inner and outer ducts.

22. The refrigerated display case of claim 21 in which the first duct is provided with at least one opening above and adjacent to the horizontal air flow diversion baffle, so that cold air can flow laterally inwards into the lower end of the first duct, whereby the air flow is balanced and excess cold air flow from the air refrigeration means bypasses the annular passage between the first duct and the second duct.

23. The refrigerated display case of claim 14 in which at least one sliding vertical door is provided about at least a portion of the outer periphery of the refrigerated display case.

24. The refrigerated display case of claim 14 in which each of said baffles is disc-shaped with a circular perimeter, and said baffles are coaxially aligned.

25. The refrigerated display case of claim 14 in which the means to pass air of elements (H) and (I) includes a backward curved centrifugal fan.

* * * * *